US008022325B2

(12) United States Patent
Tsai et al.

(10) Patent No.: US 8,022,325 B2
(45) Date of Patent: Sep. 20, 2011

(54) KEYSWITCH AND KEYBOARD

(75) Inventors: Wen-Yu Tsai, Dacheng Township, Changhua County (TW); Lei-Lung Tsai, Sinjhuang (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 129 days.

(21) Appl. No.: 12/575,265

(22) Filed: Oct. 7, 2009

(65) Prior Publication Data

US 2010/0089737 A1 Apr. 15, 2010

(30) Foreign Application Priority Data

Oct. 9, 2008 (TW) ..... 97218175 U

(51) Int. Cl.
*H01H 13/70* (2006.01)

(52) U.S. Cl. ..... 200/344

(58) Field of Classification Search ..... 200/5 A, 200/344, 512–517, 345, 520, 341–343
See application file for complete search history.

(56) References Cited

U.S. PATENT DOCUMENTS

2002/0020617 A1* 2/2002 Inoue ..... 200/344
2002/0175063 A1* 11/2002 Ito et al. ..... 200/344
2007/0125626 A1* 6/2007 Yamada et al. ..... 200/5 A

* cited by examiner

*Primary Examiner* — Edwin A. Leon
(74) *Attorney, Agent, or Firm* — Winston Hsu; Scott Margo

(57) ABSTRACT

The invention discloses a keyboard comprising a substrate and a plurality of keyswitches. The keyswitches are disposed on the substrate. The substrate includes a first connection portion and a reinforcement structure. The first connection portion is formed from bending the substrate. Each keyswitch includes a keycap and a lift support device. The keycap has a second connection portion. The lift support device is disposed between the keycap and substrate. The lift support device has a third connection portion and a fourth connection portion. The first connection portion is connected to the third connection portion, and the second connection portion is connected to the fourth connection portion. The lift support device is used for carrying the keycap to move vertically relative to the substrate. The reinforcement structure can enhance the connection strength between the first connection portion and the substrate.

12 Claims, 5 Drawing Sheets

KEYSWITCH AND KEYBOARD

BACKGROUND OF THE INVENTION

1. Field of the Invention

The invention relates to a keyswitch and a keyboard and, more particularly, to a keyswitch and a keyboard with reinforcement structure.

2. Description of the Prior Art

Recently, various consumer electronics become popular to our daily life, e.g. computer, PDA or smart phone, etc. In the meantime, various types of input devices are developed according to different applications. The most common input device for the electronics products right now is the keyboard, and the keyswitch is one of the basic components of the keyboard. In order to achieve better portability and mobility of the electronics products, the keyswitch and keyboard are in a trend to slimmer and more compact designs.

Please FIG. 1 and FIG. 2. FIG. 1 is a schematic diagram illustrating a keyboard 1 in prior art. FIG. 2 is a sectional view diagram illustrating a keyswitch 12 of the keyboard 1 in FIG. 1 along A-A direction. As shown in FIG. 1, the keyboard 1 includes a substrate 10 and keyswitches 12 disposed on the substrate 10.

As shown in FIG. 2, each keyswitch 12 includes a keycap 14 and a lift support device 16 respectively. The lift support device 16, disposed between the keycap 14 and the substrate 10, can be used for carrying the keycap 14 to move vertically relative to the substrate 10. There are first connection portions 100 disposed on the substrate 10. The first connection portions 100 are used for connecting with the lift support device 16 and providing connection strength for the vertical movement of the keycap 14.

Please refer to FIG. 3. FIG. 3 is an outside perspective view illustrating the substrate 10 in FIG. 2. The first connection portions 100 are formed from bending the substrate 10. In order to realize a slim and compact keyboard in practical application, the substrate 10 of the keyboard 1 usually adopt a thin aluminum plate, because that the aluminum material has advantages in high ductility, light weight and anti-rust. However, the aluminum material lacks sufficient rigidity compared to other materials. For example, the rigidity of the steel material reaches 29000 kilo-pound-force per square inch (Ksi); the rigidity of the titanium material reaches 15250 Ksi; the rigidity of the aluminum material is only 10500 Ksi. Therefore, the first connection 100 and the substrate 10 made of aluminum material suffer the problem of insufficient connection strength. When the first connection 100 is pulled by the lift support device 16 while the keycap 14 is moving, the first connection 100 may be deformed or deviated from normal position. It harms the durability and stability of the keyswitch 10 and the keyboard 1.

The invention discloses a keyswitch and a keyboard with reinforcement structure, which can elevate the durability and stability of the keyswitch and the keyboard, to solve aforesaid problems.

SUMMARY OF THE INVENTION

A scope of the invention is to provide a keyswitch with reinforcement structure, which can effectively elevate the durability and stability of the keyswitch. The keyswitch includes a substrate, a keycap and a lift support device. The lift support device is disposed between the keycap and the substrate.

The substrate includes a first connection portion and a reinforcement structure. The first connection portion is formed from bending the substrate. The reinforcement structure is used for enhancing connection strength between the first connection portion and the substrate. The keycap has a second connection portion. The lift support device has a third connection portion and a fourth connection portion. The third connection portion is used for connecting with the first connection portion. The fourth connection portion is used for connecting with the second connection portion. The lift support device is used for carrying the keycap to move vertically relative to the substrate.

Another scope of the invention is to provide a keyboard, which includes a substrate and a plurality of keyswitches disposed on the substrate. Each keyswitch of the keyboard has the structure similar to the aforesaid scope of the keyswitch.

Aforesaid reinforcement structure may enhance the connection strength between the first connection portion and the substrate, so as to prevent the first connection portion from being deformed or displaced because of the pulling force from the lift support device.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
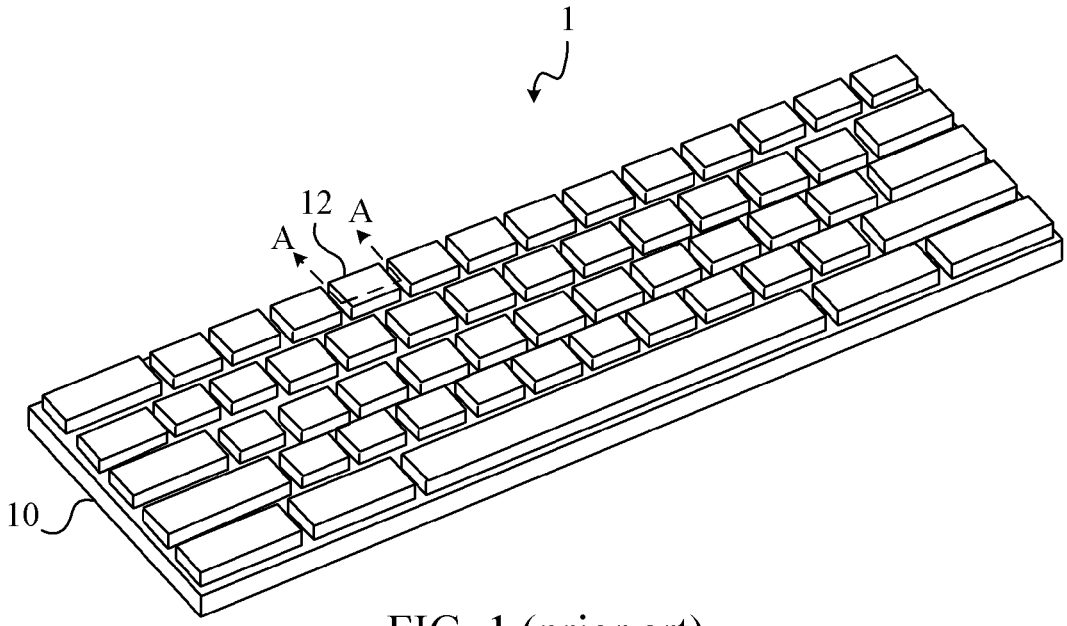
FIG. 1 (prior art)
FIG. 1 is a schematic diagram illustrating a keyboard in prior art.
Figure 2:
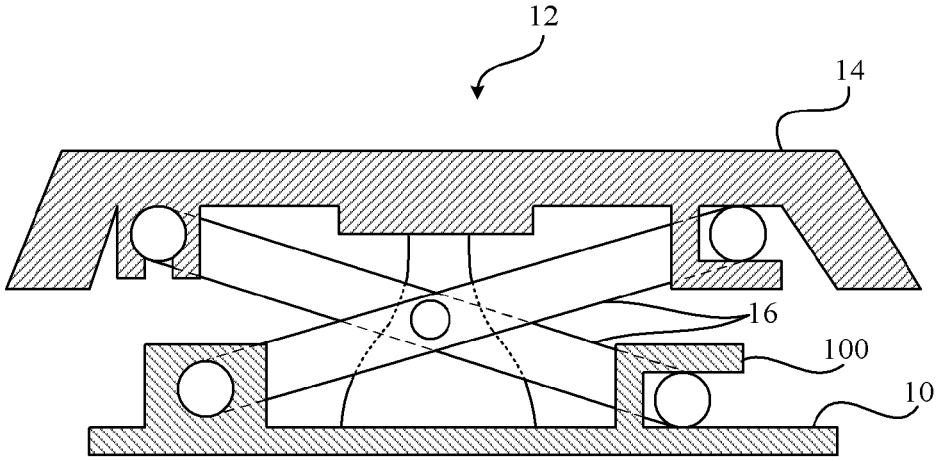
FIG. 2 (prior art)
FIG. 2 is a sectional view diagram illustrating a keyswitch of the keyboard in FIG. 1 along A-A direction.
Figure 3:
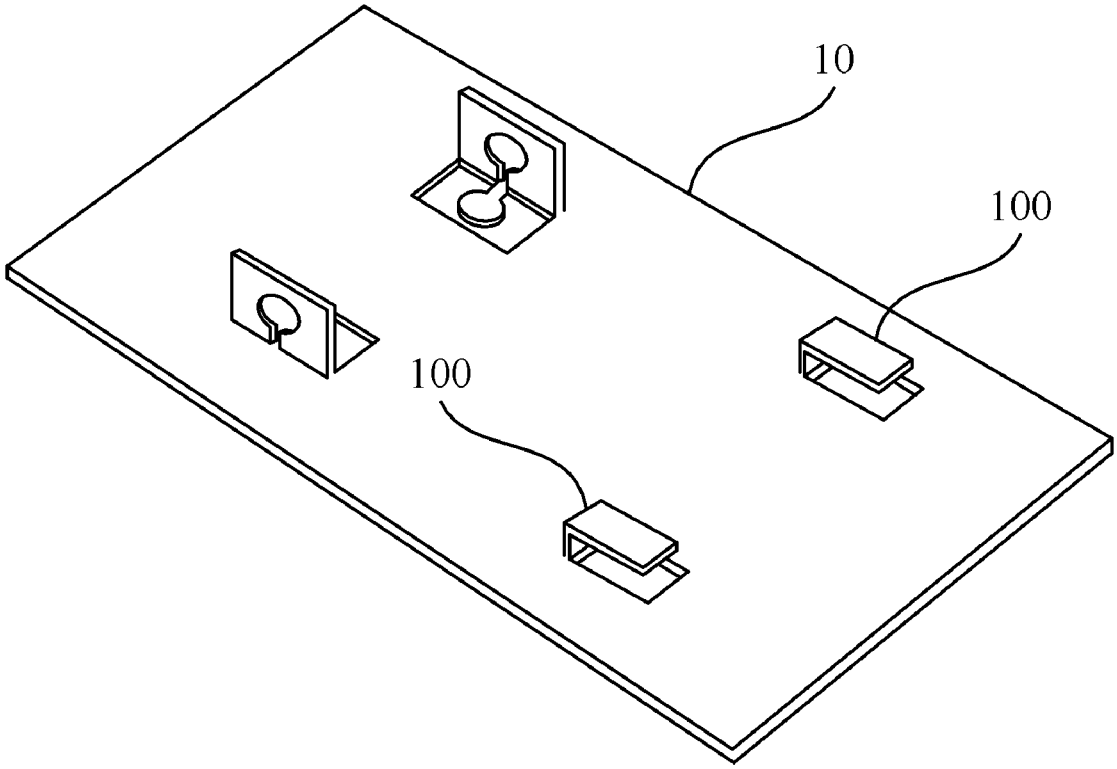
FIG. 3 (prior art)
FIG. 3 is an outside perspective view illustrating the substrate in FIG. 2.
Figure 4:
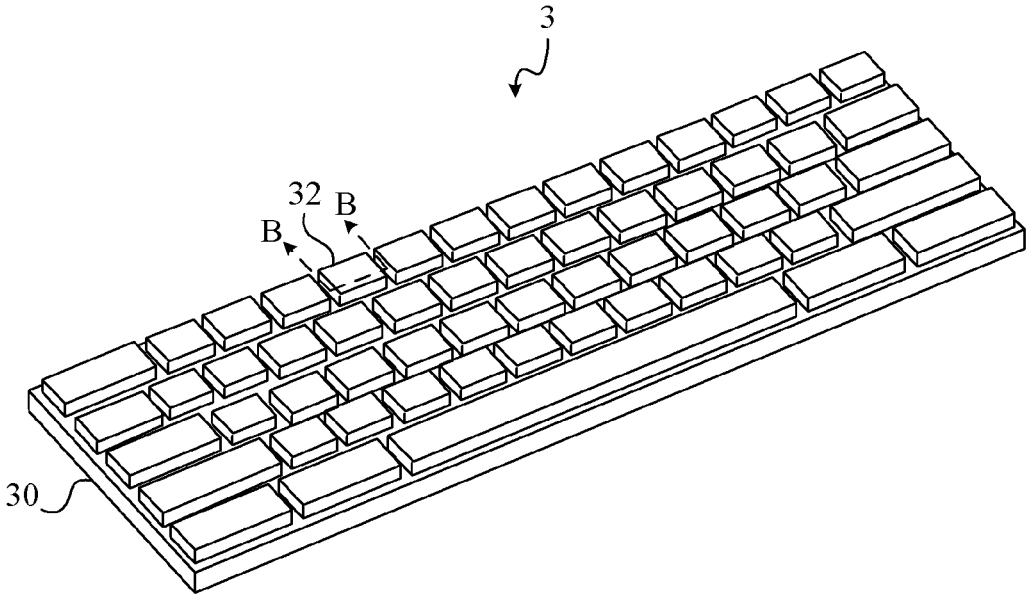
FIG. 4 is a schematic diagram illustrating a keyboard according to a first embodiment of the invention.
Figure 5:
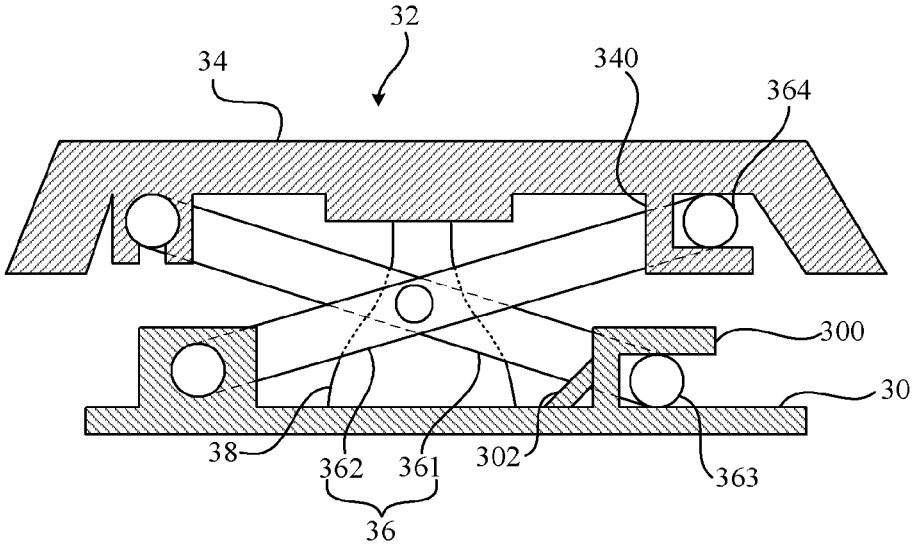
FIG. 5 is a sectional view diagram illustrating the keyboard in FIG. 4 along B-B direction.

Please refer to FIG. 4 and FIG. 5. FIG. 4 is a schematic diagram illustrating a keyboard 3 according to a first embodiment of the invention. FIG. 5 is a sectional view diagram illustrating the keyboard 3 in FIG. 4 along B-B direction. As shown in FIG. 4, the keyboard 3 includes a substrate 30 and a plurality of keyswitches 32. The keyswitches 32 are disposed on the substrate 30, and can be pressed or manipulated by users in typing or activating some other functions.

As shown in FIG. 5, each keyswitch includes a keycap 34, a lift support device 36 and a flexible component 38 respectively. Each keyswitch 32 is disposed on a different location over the substrate 30. In other word, one singular keyswitch 32 can correspond to one part of the substrate 30. On the other hand, it can be viewed as that each singular keyswitch 32 includes one part of the substrate 30.

The lift support device 36 is disposed between the keycap 34 and the substrate 30. The lift support device 36 includes a first support component 361 and a second support component 362. The first support component 361 and the second support component 362 are pivotally connected in a scissors shape.

The first support component 361 and the second support component 362 may rotate relatively, to bring the keycap 34 up and down relative to the substrate 30.

As shown in FIG. 5, the flexible component 38 is disposed between the keycap 34 and the substrate 30. The flexible component 38 can be utilized as a storing medium for the elastic force. The elastic force is utilized to cooperate with lift support device 36, for driving the keycap 34 upward or downward relative to the substrate 30. The flexible component 38 can be a rubber, but not limited to this.

The substrate 30 includes a first connection portion 300 and a reinforcement structure 302. The first connection portion 300 is formed from bending one part of the substrate 30. The keycap 34 has a second connection portion 340. The lift support device 36 has a third connection portion 363 and a fourth connection portion 364. The first connection portion 300 is connected with the third connection portion 363. The second connection portion 340 is connected with the fourth connection portion 364. Accordingly, the keycap 34 is indirectly connected to the substrate 30 through the lift support device 36. The lift support device 36 may carry the keycap 34 to move vertically relative to the substrate 30. In the meantime, the reinforcement structure may enhance the connection strength between the first connection 300 and the substrate 30, so as to prevent the first connection portion 300 from being deformed or displaced because of the pulling force from the lift support device 36 while the keycap 34 is moving.

Figure 6:
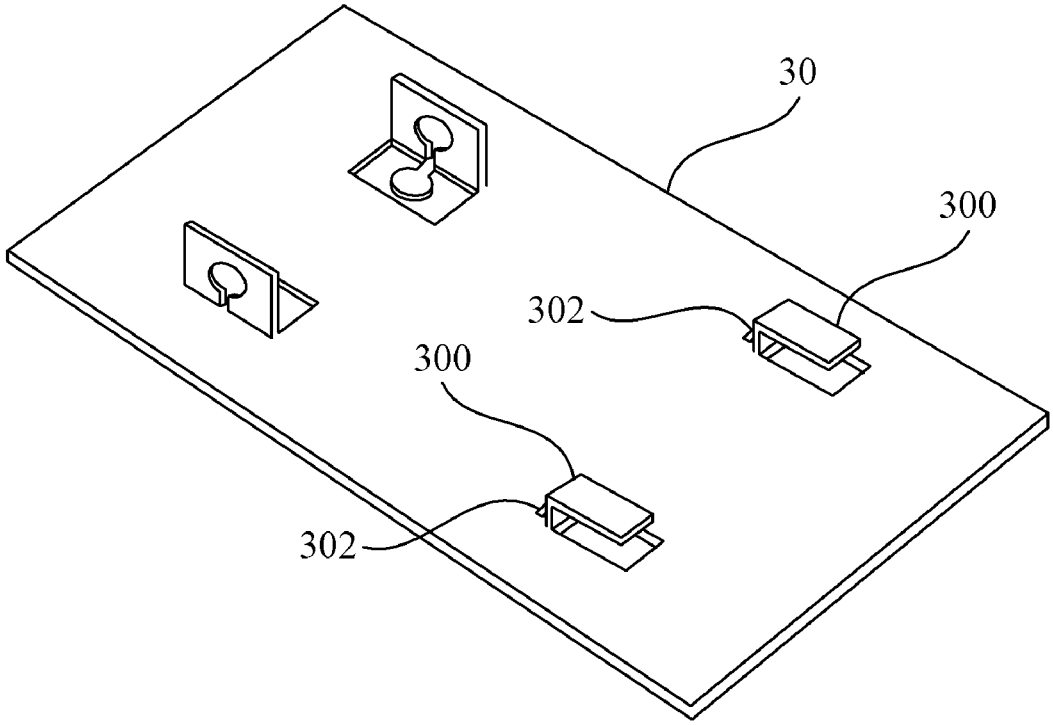
FIG. 6 is an outside perspective view illustrating the substrate in FIG. 5.
Figure 7:
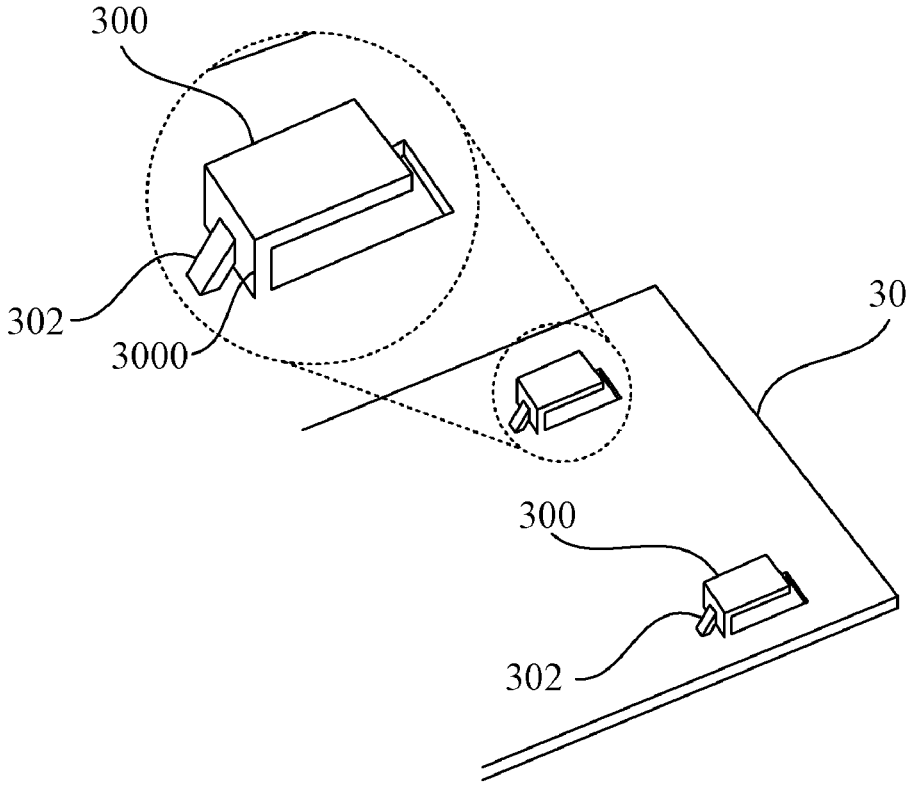
FIG. 7 is an outside perspective view illustrating the first connections and the reinforcement structures in FIG. 6.

Please refer to FIG. 6 and FIG. 7. FIG. 6 is an outside perspective view illustrating the substrate 30 in FIG. 5. FIG. 7 is an outside perspective view illustrating the first connections 300 and the reinforcement structures 302 in FIG. 6.

As shown in FIG. 6, in manufacture of the substrate 30, U-shaped segments are carved out on a plant substrate. Then, each U-shaped segment of the plant substrate is bended to form one first connection portion 300 on the substrate 30. As shown in FIG. 7, each first connection portion 300 includes a bending portion 3000 for connecting to the substrate 30. In this embodiment, the reinforcement structure 302 is a rip portion formed on the bending portion 3000. The rap portion can be used to enhance the connection strength between the substrate 30 and the first connection portion 300.

In the embodiment, the reinforcement structure 302 may enhance the connection strength between the substrate 30 and the first connection portion 300 without increasing the thickness of the substrate 30. In this way, the bending portion 3000 can stand more stress without being deformed or displaced. Therefore, the keyswitch 32 of the keyboard 3 may have better durability and stability.

In practical applications, the substrate 30 may further go through a plating process or an anodizing process. Performing the plating process or the anodizing process on the substrate 30 may elevate the strength of the substrate 30, such that the connection strength between the first connection portion 300 and the substrate 30 can be enhanced.

Figure 8:
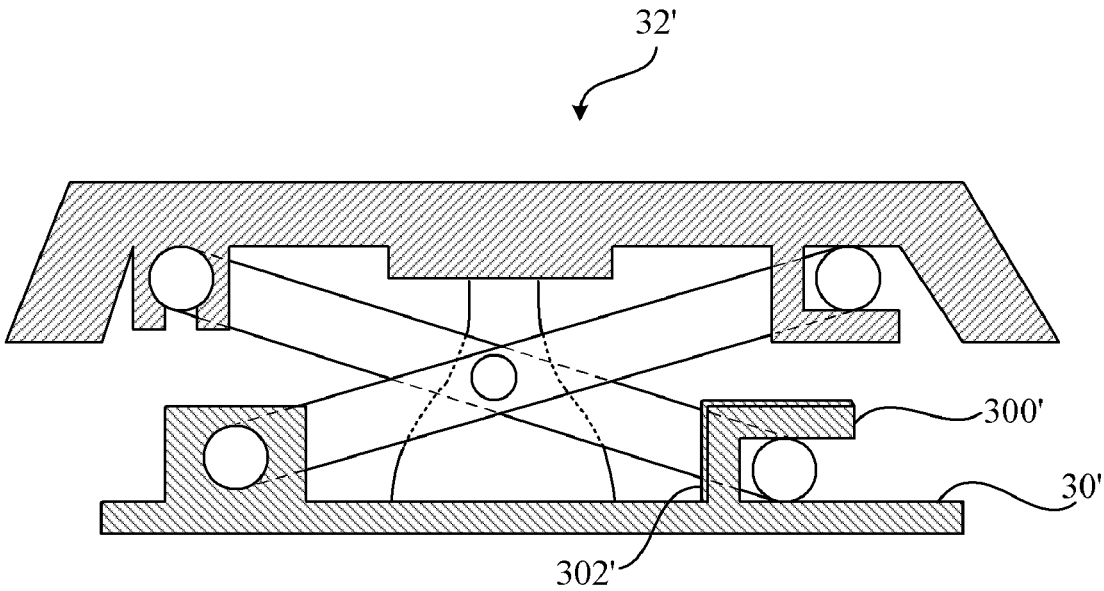
FIG. 8 is a sectional view diagram illustrating a keyswitch according to a second embodiment of the invention.
Figure 9:
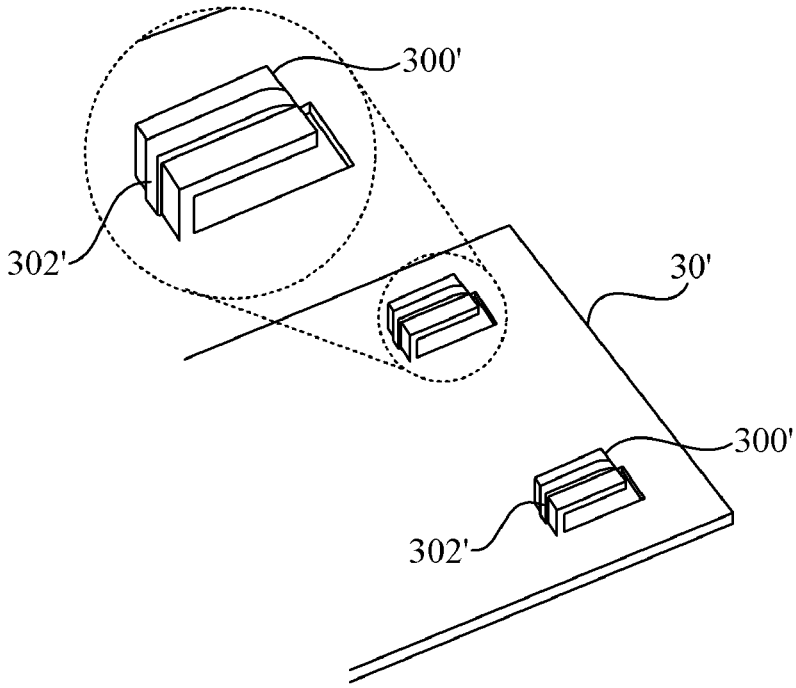
FIG. 9 is an outside perspective view illustrating the first connection portions and the reinforcements in FIG. 8.

Please refer to FIG. 8 and FIG. 9. FIG. 8 is a sectional view diagram illustrating a keyswitch 32' according to a second embodiment of the invention. FIG. 9 is an outside perspective view illustrating the first connection portions 300' and the reinforcements 302' in FIG. 8. The main difference between the first and the second embodiment is that, each first connection portion 300' in the second embodiment is punched and raised to form a convex portion. The convex portion is served as the reinforcement structure 302'. In the second embodiment, the reinforcement structure 302' may enhance the connection strength between the substrate 30' and the first connection portion 300' without increasing the thickness of the substrate 30'. In this way, the keyswitch 32' may have better durability and stability. Other structures in the keyswitch 32' are similar to the keyswitch in the first embodiment, and are repeated here.

In another embodiment, the first connection portion 300' can be punched and dinted to form a concave portion. The concave portion may serve as the reinforcement structure as well.

Compared to prior art, the reinforcement structure in this invention may enhance the connection strength between the first connection portion and the substrate, so as to prevent the first connection portion from being deformed or displaced because of the pulling force from the lift support device.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A keyswitch, comprising:

a substrate comprising a first connection portion and a reinforcement structure, the first connection portion being formed from bending the substrate, the reinforcement structure being used for enhancing connection strength between the first connection portion and the substrate, wherein the reinforcement structure is a rip portion formed on a bending portion of the first connection portion where the first connection portion is connected with the substrate, and the first connection portion is raised or dinted for forming the reinforcement structure;

a keycap, the keycap having a second connection portion; and a lift support device disposed between the keycap and the substrate, the lift support device having a third connection portion and a fourth connection portion, the third connection portion being used for connecting with the first connection portion, the fourth connection portion being used for connecting with the second connection portion, the lift support device being used for carrying the keycap to move vertically relative to the substrate.

2. The keyswitch of claim 1, wherein a plating process is performed on the substrate for enhancing the connection strength between the first connection portion and the substrate.

3. The keyswitch of claim 1, wherein an anodizing process is performed on the substrate for enhancing the connection strength between the first connection portion and the substrate.

4. The keyswitch of claim 1, wherein the lift support device comprises a first support component and a second support component, and the first support component and the second support component are pivotally connected in a scissors shape.

5. The keyswitch of claim 1, further comprising a flexible component disposed between the keycap and the substrate.

6. The keyswitch of claim 5, wherein the flexible component is a rubber.

7. A keyboard, comprising:

a substrate comprising a first connection portion and a reinforcement structure, the first connection portion being formed from bending the substrate, the reinforcement structure being used for enhancing connection strength between the first connection portion and the substrate, wherein the reinforcement structure is a rip portion formed on a bending portion of the first connection portion where the first connection portion is connected with the substrate, and the first connection portion is raised or dinted for forming the reinforcement structure; and a plurality of keyswitches disposed on the substrate, each keyswitch comprising:

a keycap, the keycap having a second connection portion; and a lift support device disposed between the keycap and the substrate, the lift support device having a third connection portion and a fourth connection portion, the third connection portion being used for connecting with the first connection portion, the fourth connection portion being used for connecting with the second connection portion, the lift support device being used for carrying the keycap to move vertically relative to the substrate.

8. The keyboard of claim 7, wherein a plating process is performed on the substrate for enhancing the connection strength between the first connection portion and the substrate.

9. The keyboard of claim 7, wherein an anodizing process is performed on the substrate for enhancing the connection strength between the first connection portion and the substrate.

10. The keyboard of claim 7, wherein the lift support device comprises a first support component and a second support component, and the first support component and the second support component are pivotally connected in a scissors shape.

11. The keyboard of claim 7, wherein each keyswitch further comprises a flexible component disposed between the keycap and the substrate.

12. The keyboard of claim 11, wherein the flexible component is a rubber.

* * * * *